US005187958A

United States Patent [19]

Prunotto et al.

[11] Patent Number: 5,187,958

[45] Date of Patent: Feb. 23, 1993

[54] METHOD OF POSITIONING A METAL SHEET FOR A SHEETMETAL WORKING MACHINE

[75] Inventors: Gianpaolo Prunotto; Franco Sartorio, both of Turin, Italy

[73] Assignee: Amada Company, Limited, Japan

[21] Appl. No.: 752,494

[22] Filed: Aug. 28, 1991

[30] Foreign Application Priority Data

Dec. 29, 1989 [IT] Italy ..... 68189 A/89

[51] Int. Cl.[5] ..... B21D 5/04; B21D 43/00

[52] U.S. Cl. ..... 72/9; 72/420; 72/422

[58] Field of Search ..... 72/9-12, 72/420, 422

[56] References Cited

U.S. PATENT DOCUMENTS

| | | | |
|---|---|---|---|
| 5,005,394 | 4/1991 | Sartorio et al. | 72/10 |
| 5,058,406 | 10/1991 | Sartorio et al. | 72/422 |

FOREIGN PATENT DOCUMENTS

| | | | |
|---|---|---|---|
| 3430463 | 3/1985 | Fed. Rep. of Germany . | |
| 3407445 | 9/1985 | Fed. Rep. of Germany . | |
| 2626506 | 8/1989 | France . | |
| 67704 | 8/1989 | Italy | 72/422 |
| 1-258827 | 10/1989 | Japan | 72/420 |
| 1-284439 | 11/1989 | Japan | 72/420 |
| 3-106524 | 5/1991 | Japan | 72/420 |
| 3-221211 | 9/1991 | Japan | 72/420 |
| 2004216 | 3/1979 | United Kingdom . | |
| 2211002 | 6/1989 | United Kingdom . | |

OTHER PUBLICATIONS

Patent Abstracts of Japan, vol. 10, No. 295, International Search Report.

*Primary Examiner*—Lowell A. Larson
*Assistant Examiner*—Donald M. Gurley
*Attorney, Agent, or Firm*—Wigman & Cohen

[57] ABSTRACT

The method is of the type in which the metal sheet (W) is manipulated by means of a movable gripping member (G) of a manipulator robot controlled by a programmer (PC) according to a program for positioning successive lines of working of the metal sheet in correspondence with a pair of linear tools (16, 18).

The programmer (PC) starts the working program by transporting the metal sheet to the position which corresponds with the first virtual or imaginary working line ($B_o$). Sensors ($S_1$, $S_2$, $S_y$) detect the position of the virtual working line and signal to the programmer whether and to what extent the position of this virtual working line differs from the correct position. This is equivalent to the entering in the programmer of a datum relating to the displacement of the engagement point ($C_o$) of the gripping member from its theoretical engagement point (C) on the metal sheet.

The programmer moves the gripping member (G) on the basis of the error detected, repositions it relative to the metal sheet (W) at the theoretical engagement point (C).

7 Claims, 4 Drawing Sheets

METHOD OF POSITIONING A METAL SHEET FOR A SHEETMETAL WORKING MACHINE

FIELD OF THE INVENTION

The present invention relates to a method of positioning a metal sheet for a sheetmetal working machine such as a bending machine, a press brake, or a shearing machine. The metal sheet is initially flat between a pair of linear tools and is manipulated by a movable gripping member of a manipulator robot controlled by a programmer according to a program for positioning successive lines of wording of the metal sheet. The program is affected by feedback signals indicating the successive positions, both spatial and angular, of the gripping member.

BACKGROUND OF THE INVENTION

According to more recent prior art, taking a bending machine as an example, bending programs are controlled by a numerical-control programmer according to a program which can be prepared on a cheap personal computer.

The operating machine generally consists of a vertical bending press with an upper movable punch and a lower fixed die, both of which are V-shaped.

A robot is associated with the bending press and carries a gripping member which may be in the form of a jaw. The gripping member can perform translational movements along three axes and rotary movements controlled by respective numerically-controlled motors. These motors are controlled in turn by the program.

The programmer receives feedback signals from sensors with which the robot is provided and these indicate to the programmer the successive linear and angular positions assumed by the gripping member.

The sensors which emit the feedback signals are of the type known as "encoders". Sensors of this type do not detect the linear and angular positions with reference to origins which are fixed once and for all, but to origins which correspond on each occasion to the linear and angular positions at the start of the operation. In practice, these origins correspond to the linear and angular positions which the gripping member and the metal sheet held thereby assume when the sheet is positioned for the formation of a first bend of the program.

In carrying out known methods, care is taken by some means or another that the metal sheet is positioned correctly for the first bend to be carried out. This positioning does not, however, take account of the fact that the jaws or other gripping member of the robot may be engaged with the metal sheet at a point which differs to a certain extent from an ideal or theoretical gripping point. Once the metal sheet has been positioned correctly for the formation of the first bend, the robot follows the program correctly as regards the successive bends to be formed. Since the gripping member is not engaged with the metal sheet at the theoretical point, however, it may follow paths so different from those envisaged that, during successive manipulations, it knocks against various obstacles including, with disastrous results, the tools of the press. This problem is more serious the smaller the metal sheets to be bent, in which case displacements of the gripping member even by a few millimeters from its estimated path may be disastrous.

SUMMARY OF THE INVENTION

The object of the invention is to provide a method for positioning a metal sheet, in which measures are adopted to prevent a jaw or other gripping member of a manipulator robot from being displaced from its intended path during the working cycle according to the program.

According to the invention, this object is achieved by means of a method of the type in question, comprising the steps of:

a) establishing a preliminary, physically-detectable, virtual working line on the metal sheet;

b) providing the programmer with the spatial and angular coordinate of a theoretical engagement point at which the gripping member is to engage the metal sheet;

c) gripping and moving the metal sheet so that the virtual working line is brought into parallel with the tools;

d) comparing the position of the actual engagement point of the gripping member with that of its theoretical engagement point when the virtual working line is in parallel with the tools, thereby deriving and storing a first position error;

e) rotating the gripping member and the metal sheet by a predetermined angle so as to bring a first actual working line into coincidence with the tools;

f) comparing the position of the actual engagement point of the gripping member with that of its theoretical engagement point, thereby deriving and storing a second position error; and g) correcting the first positioning error by means of corresponding movement of the gripping member and the metal sheet;

h) holding the metal sheet between the tools without working it and releasing the gripping member from the metal sheet;

i) moving the gripping member to the theoretical engagement point according to the first and second position error; and j) carrying out the working program starting with the first working line.

By virtue of this concept, and as will be understood better from the following, the method according to the invention comprises the addition of an imaginary working line at the start of the program which is prepared, for example, on a personal computer.

The programmer starts the working program by transporting the metal sheet to the position which corresponds with the first virtual or imaginary working line. At this point, the method according to the invention provides for the use of detection means which detect the position of the virtual working line and signal to the programmer whether and to what extent the position of this virtual working line differs from the correct position. This is equivalent to the entering in the programmer of a datum relating to the displacement of the engagement point of the gripping member from its theoretical engagement point on the metal sheet.

According to the invention, after the metal sheet has been positioned correctly according to the program for the formation of the first actual working line, the programmer moves the gripping member alone and, on the basis of the error detected, repositions it relative to the metal sheet at the theoretical engagement point.

This last operation ensures that, throughout the program, the gripping member of the robot follows the predetermined paths along which no obstacles will be encountered.

DETAILED DESCRIPTION OF THE PREFERRED EMBODIMENTS

Figure 1:
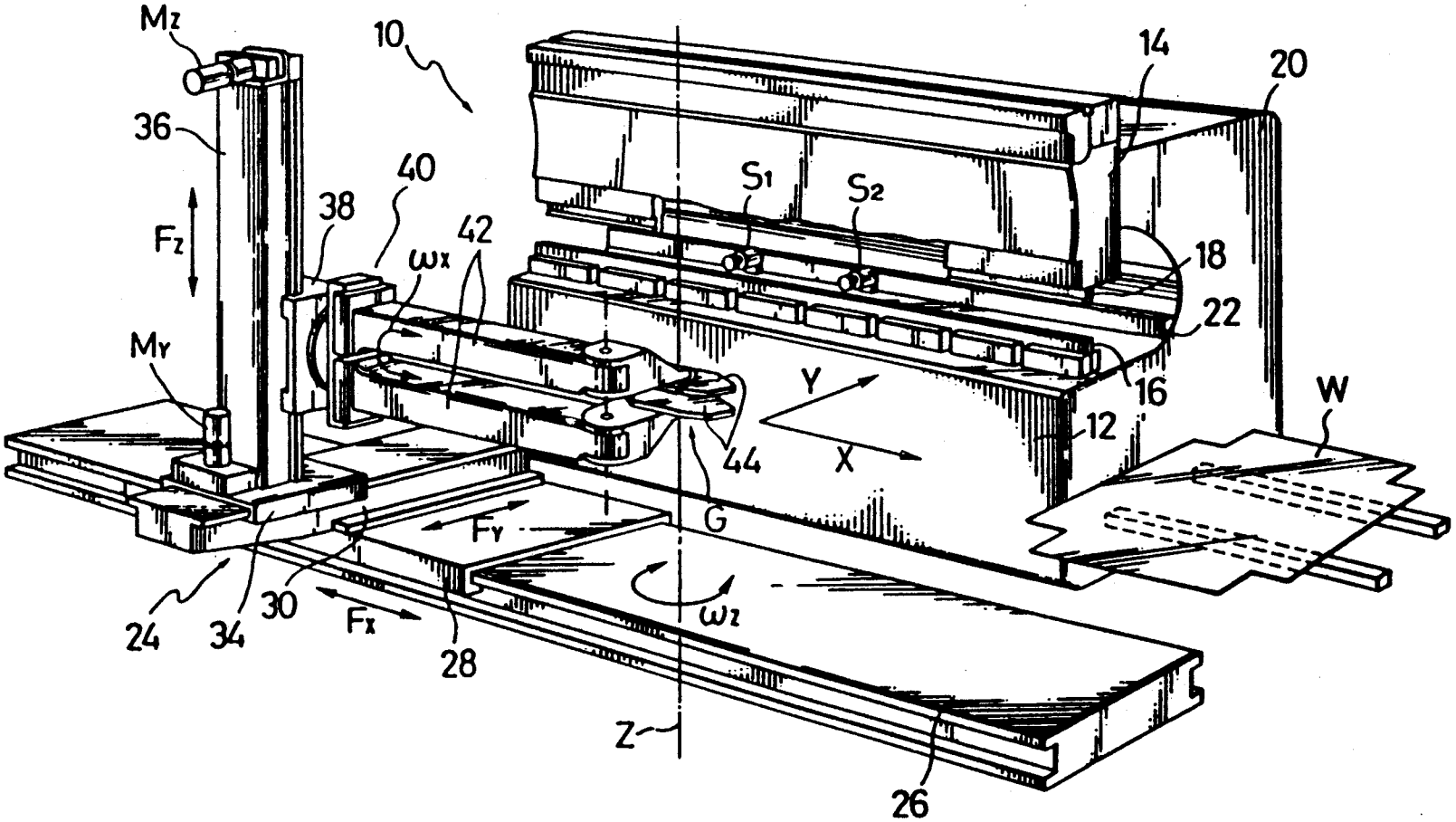
FIG. 1 is a perspective view of a sheet-metal bending press some of which is removed to show internal details, and of a robot associated with the press for manipulating metal sheets.
Figure 2:
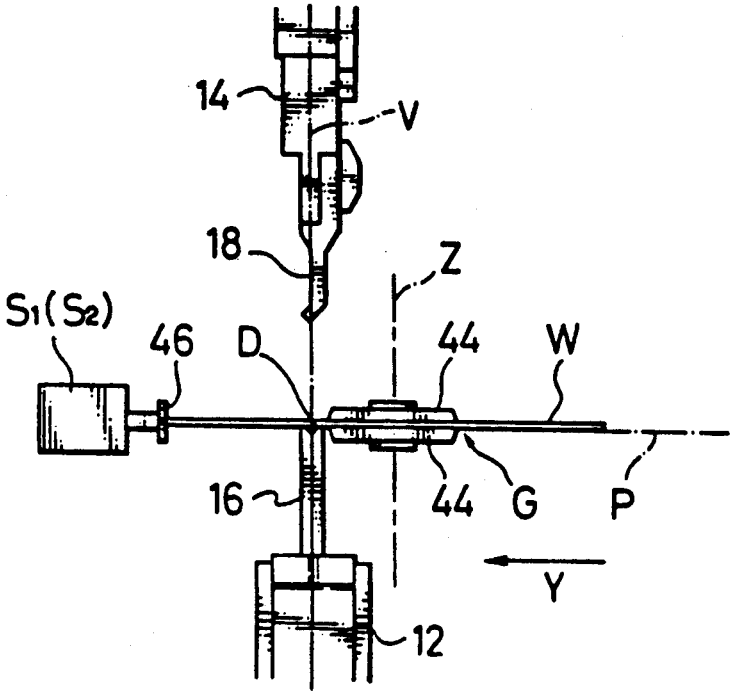
FIG. 2 is a schematic elevational view which shows, amongst other things, the die and the punch of the press, a metal sheet inserted between these tools and held by a jaw, and one of the sensors for sensing the position of an edge of the metal sheet.

With reference to FIGS. 1 and 2, a bending press of known type, generally indicated 10, comprises a lower fixed cross member 12 and an upper cross member 14 which can move up and down.

The lower cross member 12 carries a fixed bending die 16 having a linear impression of well-known V-shaped cross-section. The upper, movable cross member 14 carries a punch 18 with an active, V-shaped, linear edge corresponding to the V-shaped impression in the die 16.

The two cross members 12 and 14 are carried by a strong framework which includes well-known C-sectioned uprights, like the one indicated 20 in FIG. 1.

A longitudinal track 22 is fixed in the channel of the uprights 20 parallel to the die 16 and the punch 18.

Detection means in the form of a pair of position sensors $S_1$, $S_2$ are mounted on the track 22 and their function will be specified below. The two sensors, $S_1$, $S_2$ are mounted so as to be adjustable along the track for the purpose which will be explained below.

With reference again to FIG. 1, a robot, generally indicated 24, for manipulating metal sheets is associated with the bending press 10. The robot 24 may, for example, be of the type described and illustrated in the document IT-A-89 67704 to which reference should be made for further details.

For the purposes of the present description, it is sufficient to say the robot 24 comprises a fixed guide 26 parallel to the tools 16, 18 of the press 10 and carrying a first slide 28 slidable along a first axis X in the two directions indicated by the double arrow $F_x$. The slide 28 in turn carries transverse guides 30 in which a second slide 34 is slidable along a second axis Y perpendicular to the first axis X in the directions of the double arrow $F_y$.

The second slide 34 carries a device 40 which is rotatable parallel to the X axis as shown by the double arrow $\omega_x$. The device 40 comprises a pair of cantilevered arms 42 which project towards the guide 26 and carry respective jaws 44 at their free ends.

The jaws 44 jointly constitute a pincer or gripping member, conventionally and generally designated G.

The jaws 44, which are also visible in FIG. 2, may be of the suction type in accordance with the document IT-A-89 67704.

The gripping member G constituted by the two jaws 44 is rotatable about a third vertical axis Z. The axis Z is movable with the gripping member G, in particular along the first axis X and the second axis Y.

FIG. 2 shows a horizontal plane P in which a flat metal sheet W to be bent is held by the gripping member G so that it rests on the die 16 during the initial operating stages of the method according to the invention.

As can be seen in FIG. 2, the two sensors $S_1$, $S_2$ have respective position feeler members 46 which are situated in the plane P. The position feeler members 46 are movable along the axis Y. The sensors $S_1$, $S_2$ comprise for example potentiometers, thus detecting distances to the tools 16, 18.

Figure 3:
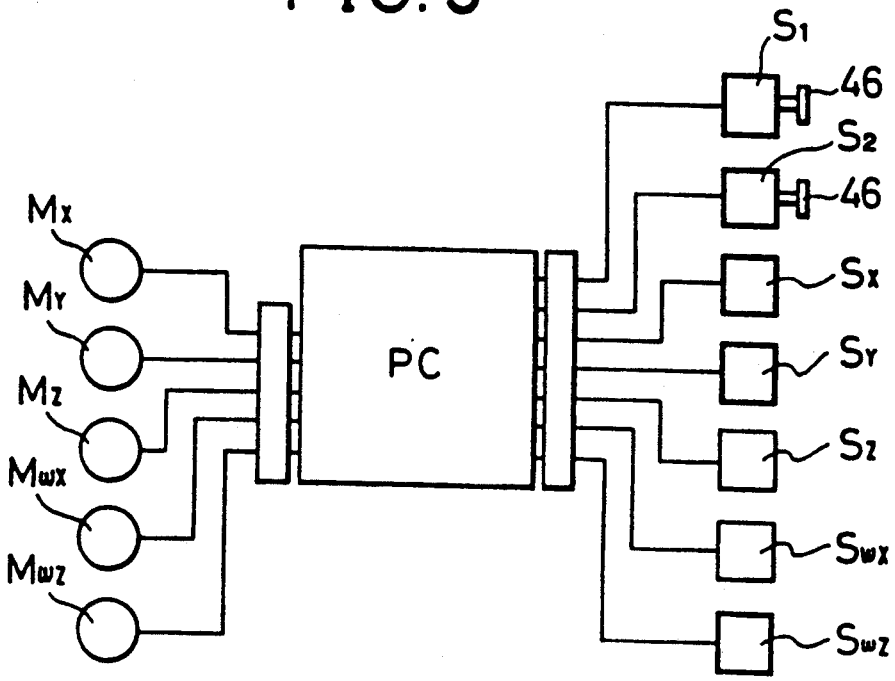
FIG. 3 is a block diagram of the control circuit of the robot.

The various movements of the robot 24 are controlled by a numerical-control programmer, indicated PC in FIG. 3. The program entered in the programmer PC on the one hand controls the numerically-controlled motors which drive the various movements of the robot 24. These motors are shown schematically on the left in FIG. 3. Some of them are also visible in FIG. 1. They comprise: a motor $M_x$ for moving the first slide 28 along the guide 26 in the direction of the X axis; a motor $M_y$ for moving the second slide 34 along the guide 30 in the direction of the Y axis; a motor $M_z$ for moving the third slide 38 along the column 36; a motor $M_{\omega x}$ for rotating the device 40 about its horizontal axis; and a motor $M_{\omega z}$ for rotating the jaws 44 of the gripping member G about the third axis Z. For simplicity, drive circuits for these motors are omitted in FIG. 3.

The programmer PC is controlled in turn by sensors which supply feedback signals thereto. These sensors are shown on the right in FIG. 3. Two of them are the position sensors $S_1$ and $S_2$ already mentioned. The other sensors are preferably of the type known as "encoders": a sensor $S_x$ detects the position of the first slide 28, that is, of the gripping member G along the X axis; a sensor $S_y$ detects the position of the second slide 34, that is, of the gripping member G along the Y axis; a sensor $S_z$ detects the vertical position of the third slide 38 and of the gripping member G; a sensor $S_{\omega x}$ detects the angular position of the device 40; and a sensor $S_{\omega z}$ detects the angular position of the gripping member G about the Z axis.

The distance from the starting point of the gripping member G to the tools 16, 18 is known in advance by the programmer PC. Therefore, the programmer PC can calculate the current distance from the gripping member G to the tools 16, 18 by using a signal from the sensor $S_y$.

In the preliminary part of the bending method, only the motors $M_x$, $M_y$ and $M_z$ and the sensors $S_1$, $S_2$, $S_x$, $S_y$ and $S_{\omega z}$ operate. These components are shown in thicker outline in FIG. 3.

A preliminary part of the bending method will now be described as it is carried out in practice.

A metal sheet W to be bent is shown on the right-band side of FIG. 1, situated at a loading station. The metal sheet W lies in the plane P which corresponds to the plane of the die 16 of FIG. 2.

The gripping member G is moved along the X axis until it engages and grips the sheet W and then returns therewith to the bending station in front of the press 10.

Figure 4:
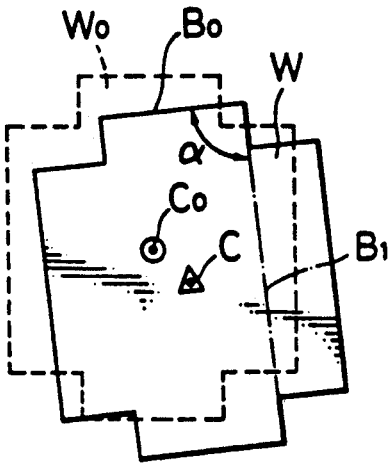
FIGS. 4, 5, 6, 7 and 8 are schematic views which show the relative positions of a metal sheet, of the bending dihedron defined by the tools of the bending press, and of the position sensors associated with the press.

In FIG. 4, the outline of a metal sheet in a correct, theoretical position in the loading station is indicated $W_o$. In practice, this situation occurs rarely and the sheet is presented to the gripping member G at the loading station in an erroneous position both with regard to the X and Y axes and to its inclination to the plane P. This situation is shown by the sheet W whose positioning errors have been exaggerated for clarity.

The program is arranged so that the metal sheet W is gripped at a theoretical engagement point which, for simplicity, is assumed to be the geometric centre of the sheet positioned correctly at $W_o$. In practice, the actual engagement point at $C_o$ of the incorrectly-positioned sheet W is offset from the theoretical engagement point, this time indicated C.

Figure 5:
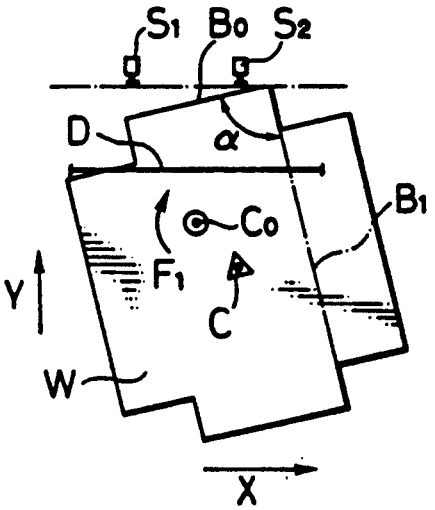

In FIG. 5, the gripping member G engaged with the sheet W at $C_o$ has transferred the latter to the bending station between the tools 16 and 18 of the press and in front of the sensors $S_1$ and $S_2$. The positions of the sensors $S_1$ and $S_2$ have been adjusted along the track 22 of FIG. 1 so that they can be engaged by an edge $B_o$ of the sheet W each near a respective end thereof. As will be understood better from the following, the edge $B_o$ constitutes, so to speak, a physically-detectable imaginary bending line.

Figure 8:
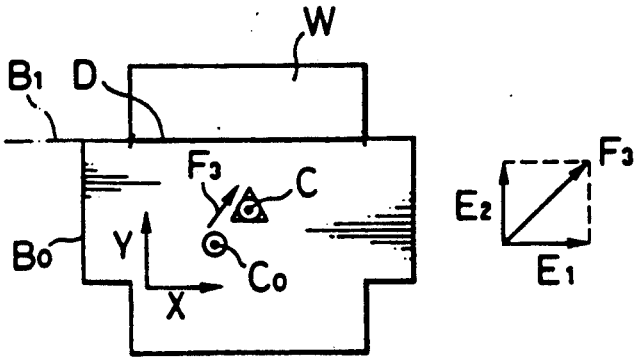

In FIGS. 4 and 8, a first actual bending line along which a first bend will be formed in the sheet W is indicated $B_1$. It is assumed, as in the simplest and most usual case, that the line $B_1$ is at an angle $\alpha$ of 90° to the edge $B_o$.

In practice, as will be understood better from the following, the programmer PC is programmed as if the sheet W were to undergo a first bend at $B_o$.

In FIGS. 5 to 8, a segment conventionally called the "bending dihedron" is indicated D and coincides with the intersection of the plane P and the vertical plane V (FIG. 2) in which the tools 16 and 18 operate.

From the condition of FIG. 4, the gripping member engaged at $C_o$ advances the sheet W along the Y axis to bring the edge $B_o$ into engagement with the position sensors $S_1$, $S_2$ (FIG. 5). The latter detect physically the position of the edge $B_o$ and send the programmer PC respective feedback signals which cause the gripping member G to rotate about the Z axis (arrow $F_1$) until the edge $B_o$ is brought into parallel with the bending dihedron D. In this situation (FIG. 6), the gripping member G situated at $C_o$ will be positioned correctly relative to the bending dihedron D in accordance with the program, but it will be in the wrong position relative to the theoretical engagement point C. The positioning error along the Y axis is indicated $E_1$.

Still assuming the theoretical engagement point is at the geometric centre of a metal sheet having a width L in the Y direction, the first error $E_1$ is calculated by the programmer PC as follows:

$$E_1 = L/2 - d_1$$

where $d_1$ is a distance from the edge $B_o$ to the actual engagement point $C_o$, which distance is detected jointly by the sensors $S_1$, $S_2$ and $S_y$ and is stored in the programmer PC.

Figure 7:
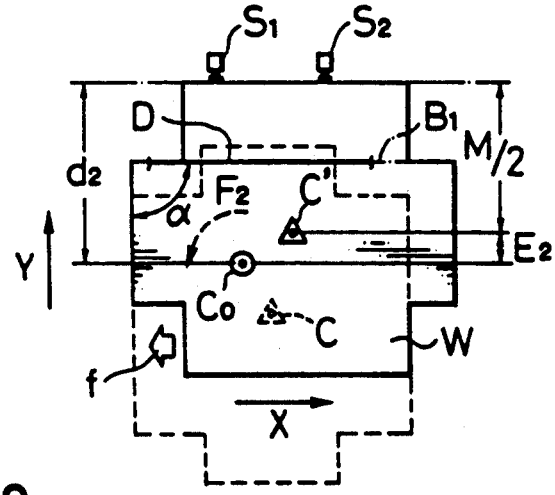

At this point, the program is arranged to move the gripping member away from the sensors $S_1$, $S_2$ and then rotate the gripping member G through the angle $\alpha$ of 90°, as shown by the arrow $F_2$ in FIG. 7, to bring the first bending line $B_1$ into coincidence with the bending dihedron D. This rotation, which takes place about the actual engagement point $C_o$, moves the theoretical engagement point C to a new position C' and the error $E_1$ is oriented along the X axis. The error signal stored in the programmer PC then causes the motor $M_x$ to operate under the control of the sensor $S_x$, in a sense such as to annul the error along the X axis. That is, the sheet W moves in the direction of an arrow f shown in FIG. 7. The correction actually takes place simultaneously with the rotation $F_2$.

$E_2$ indicates a second position error which is calculated by the programmer PC as follows:

$$E_2 = d_2 - M/2$$

where M/2 is a predetermined constant; $d_2$ is detected like $d_1$ jointly by the sensors $S_1$, $S_2$ and $S_y$ and is stored in the programmer PC.

The condition shown in FIG. 8 is thus reached, in which the first actual bending line $B_1$ is not only aligned with but is also centred relative to the bending dihedron D. However, the gripping member G is still engaged with the sheet W at the wrong point $C_o$.

Figure 9:
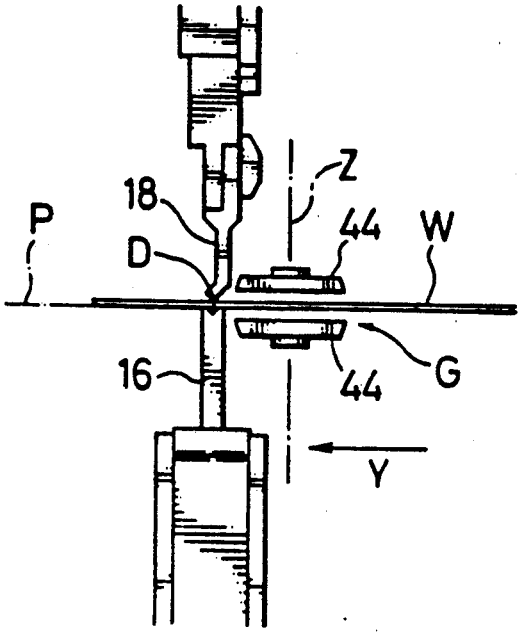
FIG. 9 is a schematic elevational view similar to FIG. 2, showing a condition corresponding to that of FIG. 8.

At this stage, according to the program, the punch 18 is lowered until it grips the sheet W between it and the die 16, as shown in FIG. 9, but does not bend the sheet. In this condition, the jaws of the gripping member G are released from the sheet W, again as shown in FIG. 9.

The coordinates of the theoretical engagement point C along the X and Y axes are already in the programmer PC. The programmer PC recognizes the first and second positioning error $E_1$, $E_2$ of the gripping member and corrects it by means of the motors $M_x$ and $M_y$, making the gripping member move in the direction of the arrow $F_3$ until it is brought to the theoretical engagement point C.

The programmer also recognizes any error in the orientation of the gripping member G about the Z axis signalled to it by the sensor $S_{\omega z}$ and corrects it by means of the motor $M_{\omega z}$.

At this stage, the bending cycle can start with the formation of the first bend $B_1$, with the assurance that the gripping member G will follow the programmed paths throughout its cycle since the origin of its movements is fixed.

In the above embodiments, the gripping member G moves from the actual engagement point to the theoretical point. However, without such movement, the bending cycles can be performed by correcting the bending programmer in view of the first and second positioning error $E_1$, $E_2$.

Figure 10:
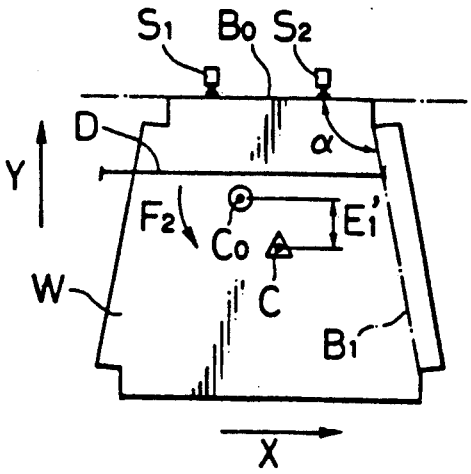
FIGS. 10 and 11 are schematic views similar to FIG. 6 and to FIG. 8 respectively, showing a variant of the method.
Figure 11:
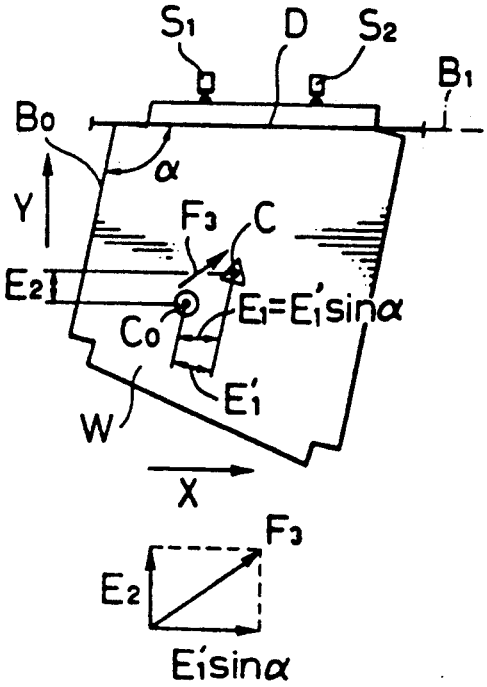

FIGS. 10 and 11 show the case in which the edge $B_o$ corresponding to the preliminary virtual bend and the first actual bend $B_1$ are inclined to each other at an angle $\alpha$ other than 90°.

Figure 6:
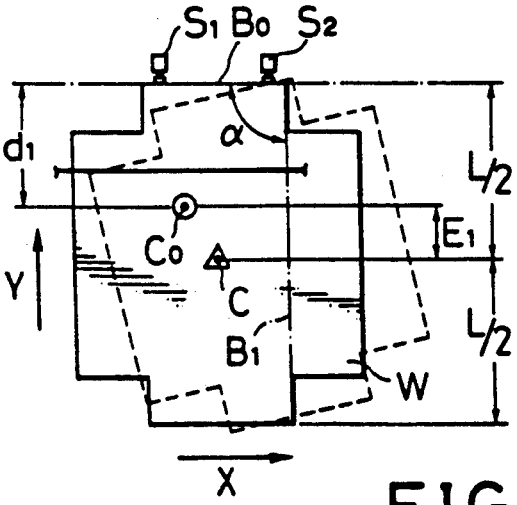

The situation of FIG. 10 corresponds to that of FIG. 6 and the error detected along the Y axis is indicated $E'_1$.

In order to bring the first bend $B_1$ into coincidence with the bending dihedron D, the sheet W is rotated about $C_o$ in the sense of the arrow $F_2$ through the angle $\alpha$. In this case, after or during the rotation through the angle $\alpha$, the correction of the error will no longer be equal to $E_1$ but to the product of the error $E'_1$ and the sine of the angle $\alpha$, that is, $E_1 = E'_1 \sin \alpha$.

The correction of the first and second positioning error $E_1$, $E_2$ then takes place for the gripping member alone as in the previous case, along the arrow $F_3$.

The present invention is also applicable to other metal sheet processing machine such as a shearing machine.

We claim:

1. A method of positioning a metal sheet which is initially flat between a pair of linear tools in which the metal sheet is manipulated by a movable gripping member of a manipulator robot controlled by a programmer according to a working program for positioning successive lines of working of the metal sheet in correspondence with the tools, comprising steps of:

a) establishing a preliminary, physically-detectable, virtual working line on the metal sheet;

b) providing the programmer with a spatial and angular coordinate of a theoretical engagement point at which the gripping member is to engage the metal sheet;

c) gripping the metal sheet by said gripping member;

d) moving the metal sheet by said gripping member so that the virtual working line is brought into parallel with the tools;

e) comparing the position of the actual engagement point of the gripping member with that of the theoretical engagement point when the virtual working line is in parallel with the tools, thereby deriving and storing a first position error;

f) rotating the gripping member and the metal sheet by a predetermined angle so as to bring a first actual working line into coincidence with the tools;

g) comparing the position of the actual engagement point of the gripping member with that of the theoretical engagement point, thereby deriving and storing a second position error;

h) correcting the first position error by means of corresponding movement of the gripping member and the metal sheet;

i) holding the metal sheet between the tools without working it and releasing the gripping member from the metal sheet;

j) moving the gripping member to the theoretical engagement point according to the first and second position error; and k) carrying out the working program starting with the first actual working line.

2. A method according to claim 1, wherein the virtual working line is an edge of the metal sheet.

3. A method according to claim 2, a pair of position sensors spaced apart in a direction parallel to the tools is used for detecting the virtual working line, the sensors being situated in the plane in which the metal sheet lies.

4. A method according to claims 1, 2 or 3, wherein the gripping member is movable along at least two axes, a first of which is parallel to the tools and a second of which is perpendicular to the tools, and which is rotatable at least about a third axis movable with the gripping member and normal to a plane in which the sheet lies at the start of the working cycle, and wherein the first acutal working line is at the predetermined angle to the virtual working line in the plane, the gripping member moving along the first and second axes and about the third axis.

5. A method of positioning a metal sheet which is initially flat between a pair of linear tools in which the metal sheet is manipulated by a movable gripping member of a manipulator robot controlled by a programmer according to a working program for positioning successive lines of working of the metal sheet in correspondence with the tools, the gripping member being movable along at least two axes, a first of which is parallel to the tools and a second of which is perpendicular to the tools, and which is rotatable at least about a third axis movable with the gripping member and normal to a plane in which the sheet lies, comprising the steps of:

a) establishing a preliminary, physically-detectable, virtual working line on the metal sheet;

b) providing the programmer with a spatial and an angular coordinate of a theoretical engagement point at which the gripping member is to engage the metal sheet;

c) gripping and moving the metal sheet to a position sensor and detecting the virtual working line;

d) detecting an angular position error of the metal sheet about the third axis;

e) rotating the gripping member about the third axis to bring the virtual working line into parallel with the tools and thus correcting the angular position error;

f) detecting a first position error of the virtual working line and correspondingly of the actual engagement point of the gripping member relative to the theoretical engagement point in the direction of the second axis;

g) rotating the gripping member and the metal sheet about the third axis through a predetermined angle to bring a first actual working line into coincidence with the tools;

h) translating the gripping member and the metal sheet along the first axis by a distance which corresponds to the product of the first position error and the sine of the predetermined angle in a direction such as to return the theoretical engagement point to a correct centered position relative to the tools;

i) gripping the metal sheet between the tools and releasing the gripping member from the metal sheet;

j) comparing the coordinates of the theoretical engagement point with those of the actual engagement point of the gripping member and deriving therefrom a second position error;

k) moving the gripping member according to the first and second position error to bring the gripping member to the theoretical engagement point;

l) carrying out the working program starting with the formation of the first actual working line.

6. A method according to claim 5, wherein an angle of 90° is selected as the predetermined angle between the first actual working line and the virtual working line.

7. A method of bending a metal sheet which is initially flat between a pair of linear tools in which the metal sheet is manipulated by a movable gripping member of a manipulator robot controlled by a programmer according to a working program for positioning successive lines of working of the metal sheet in correspondence with the tools, comprising the steps of:

a) establishing a preliminary, physically-detectable, virtual working line on the metal sheet:

b) providing the programmer with a spatial and an angular coordinate of a theoretical engagement point at which the gripping member is to engage the metal sheet;

c) gripping and moving the metal sheet so that the virtual working line is brought into parallel with the tools;

d) comparing the position of the actual engagement point of the gripping member with that of its theoretical engagement point when the virtual working line is in parallel with the tools, thereby deriving and storing a first position error;

e) rotating the gripping member and the metal sheet by a predetermined angle so as to bring a first actual working line into coincidence with the tools;

f) comparing the position of the actual engagement point of the gripping member with that of its theoretical engagement point, thereby deriving and storing a second position error; and g) carrying out the working program with starting with the first working line, while correcting the working program according to the first and second error.

* * * * *